US010065097B2

(12) United States Patent
Sagle

(10) Patent No.: US 10,065,097 B2
(45) Date of Patent: Sep. 4, 2018

(54) BASKETBALL SHOOTING INSTRUCTION DEVICE

(71) Applicant: Douglas Sagle, Williamsville, IL (US)

(72) Inventor: Douglas Sagle, Williamsville, IL (US)

( * ) Notice: Subject to any disclaimer, the term of this patent is extended or adjusted under 35 U.S.C. 154(b) by 117 days.

(21) Appl. No.: 14/704,930

(22) Filed: May 5, 2015

(65) Prior Publication Data

US 2015/0328518 A1 Nov. 19, 2015

Related U.S. Application Data

(60) Provisional application No. 61/994,100, filed on May 15, 2014.

(51) Int. Cl.
*A63B 69/00* (2006.01)

(52) U.S. Cl.
CPC ..... *A63B 69/0071* (2013.01); *A63B 69/0057* (2013.01); *A63B 2208/0204* (2013.01); *A63B 2225/09* (2013.01); *A63B 2225/093* (2013.01)

(58) Field of Classification Search
CPC ..... A63B 69/0071; A63B 69/0057; A63B 2225/09; A63B 2225/093; A63B 2208/0204
USPC ..... 473/420
See application file for complete search history.

(56) References Cited

U.S. PATENT DOCUMENTS 4,383,685 A 5/1983 Bishop
4,538,808 A * 9/1985 Holland ..... A63B 69/0071 473/447
4,565,527 A * 1/1986 Burchett ..... A63B 69/0071 273/371
4,998,731 A * 3/1991 Bowen ..... A63B 69/0057 434/252
5,324,026 A 6/1994 Conlon et al.
5,485,993 A * 1/1996 Lipsett ..... A63B 69/0071 473/448
5,599,016 A 2/1997 Larkin
5,800,291 A * 9/1998 Grover ..... A63B 69/0071 473/422
6,213,899 B1 4/2001 Maske
6,299,570 B1 * 10/2001 Lim ..... A63B 21/00047 434/248
6,358,163 B1 * 3/2002 Tanner ..... A63B 69/0002 124/5
6,497,627 B2 * 12/2002 Collins ..... A63B 69/0057 473/257
6,544,132 B1 * 4/2003 Tvedt ..... A63B 69/0071 273/402
6,575,844 B1 * 6/2003 Gray ..... A63B 69/3608 473/273
6,843,730 B1 * 1/2005 Bellagamba ..... A63B 69/0057 473/207
6,949,034 B2 9/2005 Vitello et al.
7,431,661 B1 * 10/2008 Cailey ..... A63B 67/02 473/257

(Continued)

*Primary Examiner* — Gene Kim
*Assistant Examiner* — Jeffrey Vanderveen
(74) *Attorney, Agent, or Firm* — Law Office of Robert M. Patino

(57) ABSTRACT

A basketball shooting instruction device for use on a ground surface is provided with a feet positioning assembly, a support pole fixedly connected to a foundation juncture of the feet positioning assembly, and a shot box positioned on an upper end of the support pole.

1 Claim, 4 Drawing Sheets

(56) References Cited

U.S. PATENT DOCUMENTS

| | | | | |
|---|---|---|---|---|
| 8,721,476 | B2 * | 5/2014 | Mayers | A63B 69/0071 473/447 |
| 8,784,229 | B1 * | 7/2014 | McCullough | A63B 69/0057 473/257 |
| 2003/0224881 | A1 * | 12/2003 | Vitello | A63B 69/0057 473/447 |
| 2004/0157685 | A1 * | 8/2004 | Hodges | A63B 69/0071 473/448 |
| 2010/0267496 | A1 * | 10/2010 | Johnson | A63B 69/0071 473/447 |
| 2014/0200102 | A1 * | 7/2014 | Frostino | A63B 69/0071 473/447 |
| 2015/0328518 | A1 * | 11/2015 | Sagle | A63B 69/0071 473/447 |

* cited by examiner

BASKETBALL SHOOTING INSTRUCTION DEVICE

RELATED APPLICATION INFORMATION

This application claims priority to U.S. Provisional Patent Application No. 61/994,100 and is incorporated herein in its entirety by this reference.

BACKGROUND OF THE INVENTION

The present invention relates to a basketball shooting instruction device, and more specifically to a training aid that assists a person shooting a basketball (also referred to as a "shooter") to have the proper form in standing and shooting a basketball to improve his or her ability to shoot a basketball consistently, accurately and with form that is advantageous when playing the game of basketball.

Basketball is a challenging sport and has many components related to the mastery of controlling the basketball. These components include dribbling, passing and shooting as the most basic components on the offensive side of the ball. For young basketball players, understanding and mastering good shooting techniques can be a challenging and difficult process. Often their feet are not squared, their elbows bend outwardly, their arch is flat, and they frequently use both hands when shooting the basketball. All of these errors in technique make for poor form and inconsistent results for the shooter. Without improving the player's technique, the shooting never improves and the shooter never becomes a good offensive basketball player. Having a basketball shooting aid can assist with muscle memory if multiple shots are practiced routinely with the basketball shooting aid and those multiple shot attempts are repeated over an extended period of time.

Several basketball shooting aids exist to help a shooter shoot a basketball but these basketball shooting aids have several shortcomings. One typical shortcoming is that the whole body is often neglected with existing training aids and devices, as one or two specific body parts are addressed with these shooting aids. For example, several of these shooting aids assist the shooter to shoot a basketball with one hand or to shoot a basketball while keeping the elbow in. In one example, U.S. Pat. No. 5,324,026, discloses a wearable elbow harness which assists the shooting arm to move up and down. In another example, U.S. Pat. No. 4,383,685, discloses a training aid in the form of a vest with a curved guide arm to assist the shooting arm go through a desired path. And yet in another example, U.S. Pat. No. 5,599,016 discloses a detachable rectangular frame that adjusts vertically to simulate when the user has shot over a defensive player's arm and assists the shooter with following through on his shot. These devices focus on the arm movement but miss other important body positioning elements.

Other basketball shooting aids do assist a shooter's lower body positioning. U.S. Pat. No. 6,949,034 discloses an apparatus that restricts the movement of the leading shin when a basketball is shot. There are also parts of the apparatus to prevent the shooter from bringing his arm down after a shot and thus encourages following through on a shot attempt. U.S. Pat. No. 6,213,899 discloses a framed structure that creates a restricting enclosure and is convertible for left and right handed shooters. However, the configuration of the inventions found in these patents are not optimized for easy adjustments for different shooters and portability from moving the device from one place to another.

Thus, there is a need for a basketball shooting aid that accommodates the required foot placement of the basketball shooter. Furthermore, there is a need for a basketball shooting aid that assists the shooter in keeping his elbow in and his arm restricted to a planar field of motion. Moreover, there is a need for a basketball shooting aid that can accommodate left and right handed shooter. The height of the basketball shooting aid should be adjustable to accommodate the varying heights and sizes of individual shooters. There is also a need for the basketball shooting aid to be portable. Portability requires that the basketball shooting aid be easy to assemble and disassemble and compactable into an easy carrying package. Additionally, there is a need for the basketball shooting aid to be stable and sturdy enough to be placed on a flat surface such as a gymnasium floor and not fall while being used or accidentally bumped.

BRIEF SUMMARY OF THE INVENTION

The above-identified needs are addressed by the present basketball shooting instruction device. One feature of the present invention is a feet positioning assembly to assist with the feet placement of the shooter when practicing with the basketball shooting instruction device. The feet positioning assembly is provided with a non-shooting foot side bar that is moveable along a non-shooting foot lead bar. The non-shooting foot lead bar is moveable along a shooting foot side bar. In this manner, the feet positioning assembly is adjustable to accommodate the shooter's legs and feet while also providing stability to the basketball shooting instruction device.

Another feature of the present invention is a height adjustable support pole that is provided and is fixedly connected to a foundation juncture of the foot positioning assembly. The height adjustable support pole is preferably moveable in a vertical direction to accommodate the various heights a shooter might need. Furthermore, a shot box is positioned on an upper end of the height adjustable support pole. The shot box is further provided with an elbow bar located on a lower, outside corner of the shot box and a guide bar located on an inside bar of the shot box. These components assist the shooter with form in keeping the non-shooting hand away from the ball when the ball is released, keeps the elbow in, and assists in following through after the shot has been attempted.

DETAILED DESCRIPTION OF THE INVENTION

Figure 1:
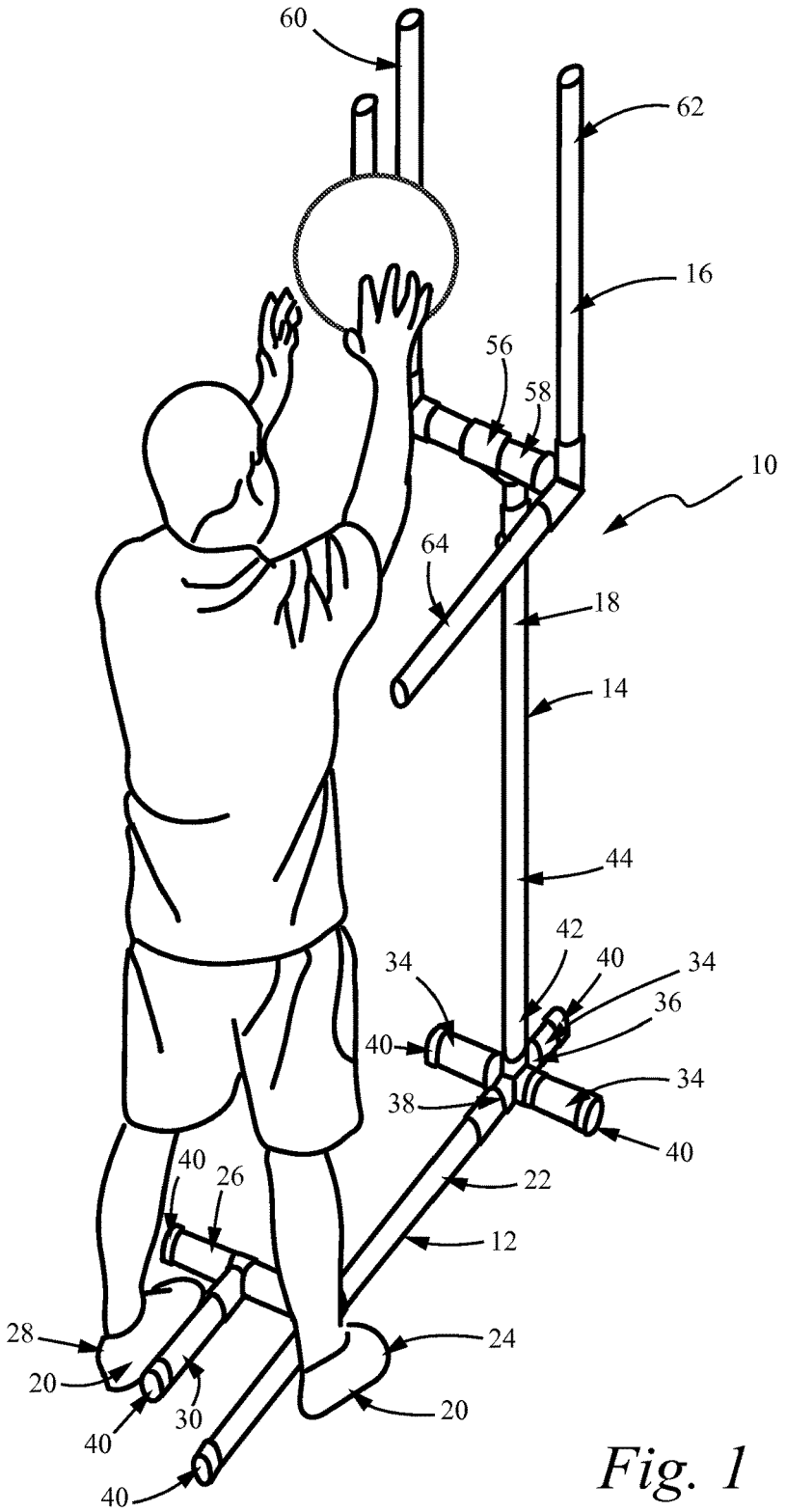
FIG. 1 is a rear perspective view of a basketball shooting instruction device with a shooter positioned to shoot a basketball.
Figure 4:
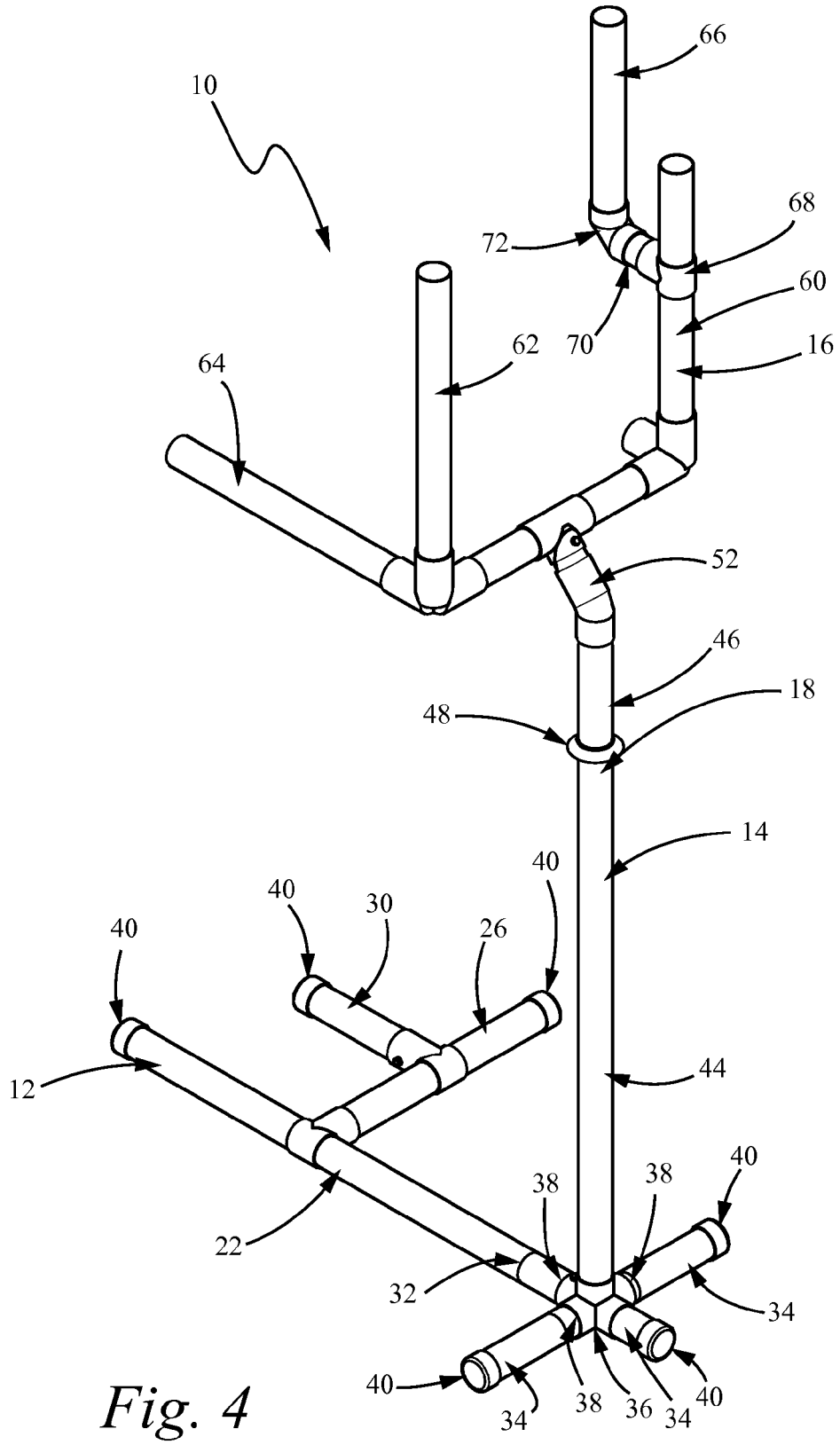
FIG. 4 is a front perspective view of an alternative embodiment of the basketball shooting instruction device.

Referring now to FIG. 1, a basketball shooting instruction device 10 for use on a ground surface is generally provided with a feet positioning assembly 12, a support pole 14 and a shot box 16. The support pole 14 is most preferably a height adjustable support pole 18 to accommodate shooters of varying heights. The adjusting feature of the height adjustable support pole 18 is best illustrated in FIG. 1 and FIG. 4 where FIG. 1 illustrates the height adjustable support pole 18 in a down position and FIG. 4 illustrates the height adjustable support pole in an up position. The feet positioning assembly 12 serves to add stability to the rest of the basketball shooting instruction device 10 and to aid with the positioning of the shooter's feet 20.

The feet positioning assembly 12 is provided with a shooting foot side bar 22. The shooting foot side bar 22 runs parallel to an inner side of the shooter's shooting foot 24. Generally, the shooting foot side bar 22 is not moveable and is made of a rigid material such as wood, metal, ceramic or plastic. The shape of the shooting foot side bar 22 is preferably cylindrical but may also be of other functional shapes such as rectangular, hexagonal or other. In the most preferred embodiment, PVC (Polyvinyl chloride) tubes are used as PVC tubes are simple, durable, light and inexpensive. In one embodiment, 1¼ inch schedule 40 PVC pipes are used with 1¼ inch PVC fittings are used to connect the various sections. The length of the shooting foot side bar 22 is sufficient enough to accommodate the shooter's shooting foot 24 along with 1 to 15 inches in front of the shooting foot and 1 to 15 inches behind the shooting foot. Preferably, the length of the shooting foot side bar 22 is from about 1 foot to 8 feet in length. More preferably, the length of the shooting foot side bar 22 is from about 2 feet to 6 feet in length. In the most preferred embodiment, the length of the shooting foot side bar 22 is from 30 inches to 40 inches in length.

Movedly affixed to the shooting foot side bar 22 is a non-shooting foot lead bar 26. The non-shooting foot lead bar 26 is made of a rigid material such as wood, metal, ceramic or plastic. The shape of the non-shooting foot lead bar 26 is preferably cylindrical but may also be of other functional shapes such as rectangular, hexagonal or other. In the most preferred embodiment, PVC tubes are used. A slip-slide PVC tee is used to make the non-shooting foot lead bar 26 moveable along the shooting foot side bar 22. The cylindrical design of the slip-slide PVC tee allows the non-shooting foot lead bar 26 to flip to the opposite side of the shooting foot side bar 22. In looking at FIG. 3, the non-shooting foot lead bar 26 would reside on the opposite side of the support pole 14. In this manner, shooters that are left handed and right handed can be accommodated by the present invention without the need of an additional basketball shooting instruction device. A left handed shooter simply has to flip the non-shooting foot lead bar 26 to the opposite side as shown in FIG. 1 to assist with his shooting needs. The non-shooting foot lead bar 26 is placed at the toe of the non-shooting foot 28 so that the shooter will have a consistent placement of his non-shooting foot 28. Preferably, the length of the non-shooting foot lead bar 26 is from about 8 inches to 4 feet in length. More preferably, the length of the non-shooting foot lead bar 26 is from about 1 foot to 2½ feet in length. In the most preferred embodiment, the length of the non-shooting foot lead bar 26 is from 12 inches to 24 inches in length.

Movedly affixed to the non-shooting foot lead bar 26 is a foot side bar 30. The foot side bar 30 is made of a rigid material such as wood, metal, ceramic or plastic. The shape of the non-shooting foot lead bar 30 is preferably cylindrical but may also be of other functional shapes such as rectangular, hexagonal or other. In the most preferred embodiment, PVC tubes are used. A slip-slide PVC tee is used to make the foot side bar 30 moveable along the non-shooting foot lead bar 26. The cylindrical design of the slip-slide PVC tee allows the foot side bar 30 to flip to the opposite side of the non-shooting foot lead bar 26. In this manner, the non-shooting foot lead bar 26 can be placed behind the heel of the non-shooting foot 28 instead of in front of his toe. A shooter may elect this position if he desires a more open position of his feet while shooting. The purpose of the foot side bar 30 is to space the feet to be roughly the same distance apart as the shoulders' of the shooter. This distance is generally accepted as the best distance for proper form, but the shooter or coach may adjust the distance as needed for the individual shooter. Preferably, the length of the foot side bar 30 is from about 6 inches to 3 feet in length. More preferably, the length of the foot side bar 30 is from about 8 inches to 18 inches in length. In the most preferred embodiment, the length of the foot side bar 30 is from 10 inches to 16 inches in length.

Towards a pole end 32 of the shooting foot side bar 22 is a plurality of stability bars 34. The plurality of stability bars 34 provide a plane of support to support a height adjustable support pole 18. The plurality of stability bars 34 and the shooting foot side bar 22 are connected together by a foundation juncture 36. The foundation juncture 36 receives each stability bar 34 and the shooting foot side bar 22 through a plurality of respective receiving holes 38. The foundation juncture 36 in one embodiment is a 5-way PVC cross of 1¼ inch in diameter receiving holes; however, other foundation junctures 36 may be used that serve the same purpose. The length of the plurality of stability bars 34 is dependent on the balance requirements of the height adjustable support pole 18 and the shot box 16. Generally one or more inches is required but less than 24 inches is generally sufficient. To further aid with the stability of the basketball shooting instruction device 10, PVC end caps 40 may optionally be provided at the end of each stability bar 34, the shooting foot side bar 22 and the non-shooting foot lead bar 26. The PVC end caps 40 will prevent slippage on a smooth surface and assist with the balance of the basketball shooting instruction device 10.

Extending upwardly at an approximate 90 degree angle from the plane created by the plurality of stability bars 34 and the shooting foot side bar 22 at the foundation juncture 36 is the support pole 14 and more preferably, the height adjustable support pole 18. The height adjustable support pole 18 is fixedly connected to the foundation juncture 36 by inserting a lower end 42 of the height adjustable support pole 18 into a corresponding receiving hole 38 of the foundation juncture 36. The shape of the height adjustable support pole 18 is preferably cylindrical but may also be of other functional shapes such as rectangular, hexagonal or other useable shape. In one particular embodiment, PVC tubes are used.

The height adjustable support pole 18 is capable of moving in a vertical direction relative to the ground surface to adjust the height of the shot box 16. To do this, a multitude of embodiments exist to achieve this. One means to achieve this adjustability is to use two separate poles that have two separate widths so that one can be received into the other. In this embodiment, a wider pole or PVC pipe is used for a lower segment 44 of the height adjustable support pole 18. In one example, a 1¼ inch schedule 40 PVC pipe. The length of the lower segment 44 is preferably between 30 inches and 50 inches. The length of the lower segment 44 is more preferably between 35 inches and 45 inches. A narrower pole or PVC pipe is used for an upper segment 46 of the height adjustable support pole 18. In the one example previously mentioned, a 1 inch schedule 40 PVC pipe may be used. The length of the upper segment 46 can vary, but generally the upper segment 46 is preferred to be less than the length of the lower segment 44. To adjust the height, the upper segment 46 is slid vertically up and down into the lower segment 44. To secure the upper segment 46 at a height, a plurality of holes with a securement pin may be used (not shown) or when using PVC piping, a washer 48 may be used. In the embodiment described herein with using a 1 inch scheduled 40 PVC pipe as the upper segment 46, a 1 inch inner diameter large rubber washer 48 works well with the 1¼ inch schedule 40 PVC pipe used for the lower segment 44. The friction created is enough to prevent slippage of the shot box and with a bit of force, the shooter or a coach can adjust the shot box to be higher or lower by moving the upper segment 46 up and down within and relative to the lower segment 44.

Figure 2:
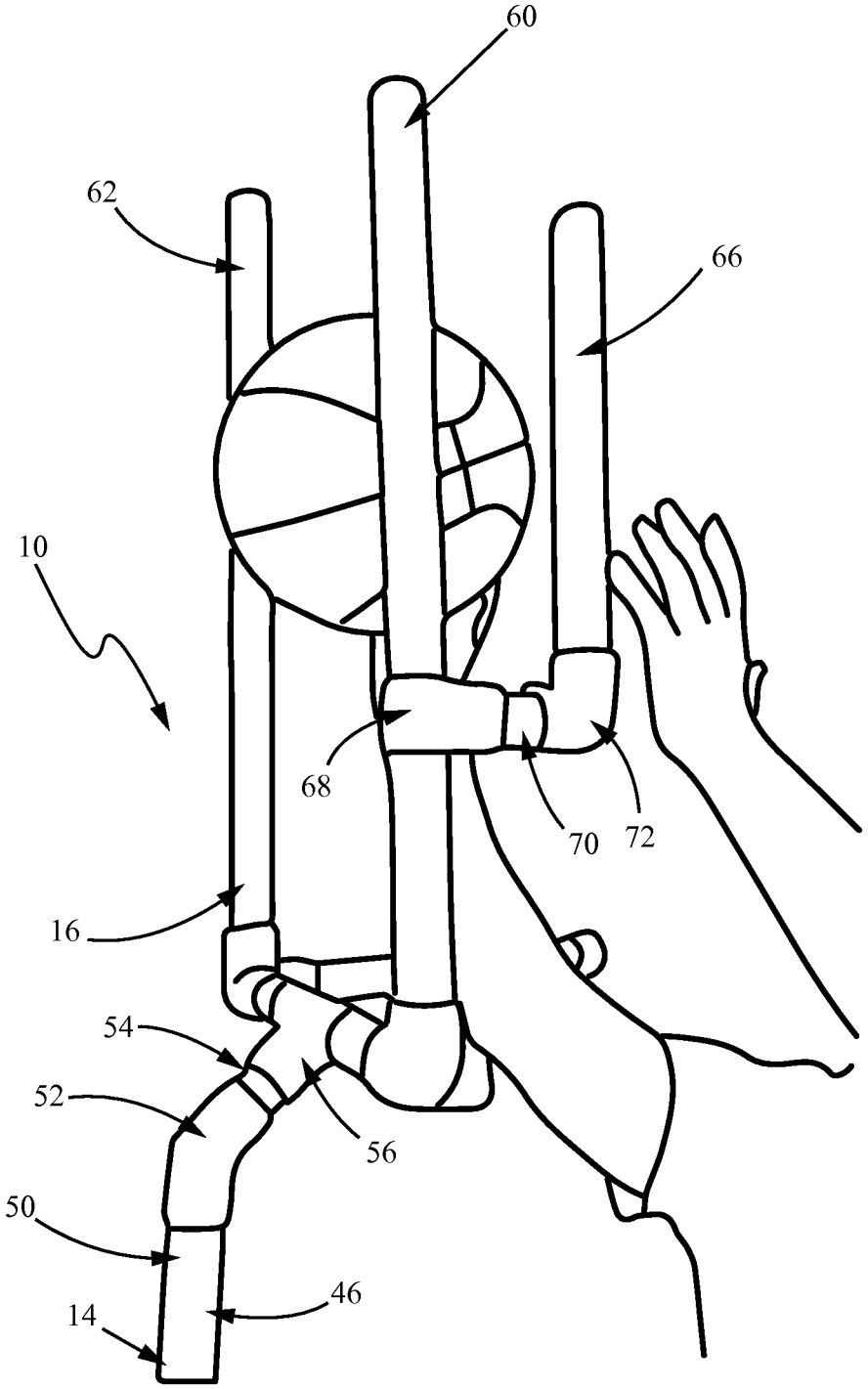
FIG. 2 is a side perspective view of an upper portion of the basketball shooting instruction device illustrating a one-handed shot through a shot box.
Figure 3:
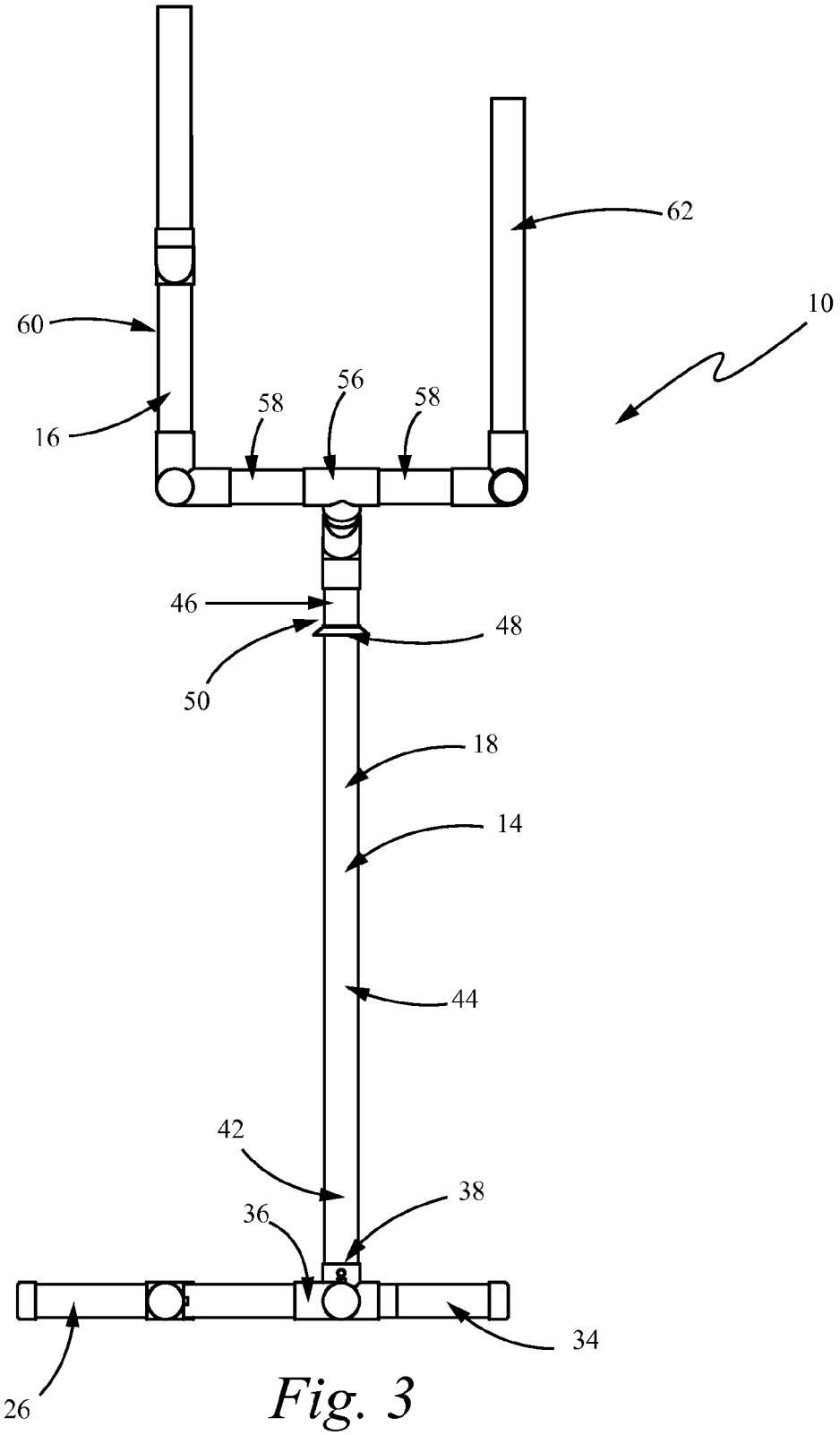
FIG. 3 is a rear planar view of the basketball shooting instruction device.

Now referring to FIGS. 2 and 3, the shot box 16 is positioned on an upper end 50 of the support pole 14 or height adjustable support pole 18. The shot box 16 is generally comprised of at least 3 sides that create an open rectangle or square that resides perpendicular to the plane created by the plurality of stability bars 34 and the shooting foot side bar 22 that a shooter has to shoot through. The shot box 16 may reside linearly with the height adjustable support pole 18, but the shot box 16 preferably resides closer to the shooter than the height adjustable support pole 18. To achieve this position, an angled elbow 52 is optionally used to extend a shot box support pole 54 in a planar direction relative to the shooting foot side bar 22 away from the height adjustable support pole 18. The shot box support pole 54 only needs to extend a few inches where as little as 1 inch to 24 inches should be sufficient. In a more preferred embodiment, the shot box support pole 54 is 2 inches to 8 inches. In one embodiment, a 45 degree PVC elbow is used as the angled elbow 52 and the shot box support pole 54 is about 3 inches long.

The shot box 16 is mounted on the shot box support pole 54 but may optionally be mounted directly on the support pole 14. In one embodiment, the mounting of the shot box 16 occurs via a 90 degree tee 56. The advantage of the 90 degree tee 56 is that the 90 degree tee 56 will hold a lower shot box bar 58 that is typically made of PVC pipe firmly but adjustably. The 90 degree tee 56 is also preferably made of PVC. The lower shot box bar 58 makes up the bottom side of the shot box 16. Thus, if the shot box 16 is not perpendicular to the plane created by the plurality of stability bars 34 and the shooting foot side bar 22, the shot box 16 can be adjusted. The lower shot box bar 58 can be one single bar if the 90 degree PVC tee 56 will accommodate one PVC pipe going through the 90 degree PVC tee 56; however, generally two small 1 inch schedule 40 PVC pipes must be used that are approximately 2-8 inches (most preferably between 3 and 6 inches) in length that extend from each side of the 90 degree PVC tee 56. An inside shot box bar 60 and an outside shot box bar 62 extend upwardly at the ends of the lower shot box bar 58 to create a shot box plane. The length of the inside shot box bar 60 and the outside shot box bar 62 may vary, but generally between 10 and 30 inches is deemed workable with a height of 21-24 inches being preferred. Optionally, the outside shot box bar 62 is longer than the inside shot box bar 60 to create stability for the shot box 16.

The shot box 16 is further provided with an elbow bar 64 located on a lower, outside corner of the shot box 16. This lower, outside corner resides where the outside shot box bar 62 and the lower shot box bar 58 meet. The elbow bar 64 extends at about a 90 degree angle from the plane create by the shot box 16 towards the shooter to assist in keeping the shooter's shooting elbow in. Thus, the elbow bar 64 preferably extends 6 to 24 inches from the plane of the shot box and may be attached to the shot box using a 3 way 90 degree PVC elbow.

A guide bar 66 is located on the inside shot box bar 60. The guide bar 66 extends vertically upward and resides parallel to the inside shot box bar 60 and is connected to the inside shot box bar by a slip-slide PVC tee 68, a connecting bar 70, and a 90 degree PVC elbow 72 attached in series. The slip-slide PVC tee 68 is provided with a means of adjustment to allow the shooter or a coach or user to adjust the height of the guide bar 66 and if desired, the guide bar 66 can be swung inwardly towards the shot box 16 to make a smaller shot box. The means of adjustment is preferably provided by a 1 inch inner diameter rubber O-ring placed around the inside shot box bar 60 and internally to the slip-slide PVC tee 68. However, the main function of the guide bar 66 is to give the shooter a point of reference on when to release the ball when shooting and keeps the non-shooting hand away from the shooting hand so as to not interfere with the form of the one-handed shot.

While a particular embodiment of the basketball shooting instruction device 10 has been described herein, it will be appreciated by those skilled in the art that changes and modifications may be made thereto without departing from the invention in its broader aspects and as set forth herein.

The invention claimed is:

1. A method of a shooter shooting a basketball with a basketball shooting instruction device, said method comprises:

determining whether the shooter desires to use his left hand or right hand as a shooter's shooting hand, arranging a shot box of the basketball shooting device to be in a planar position, wherein the basketball shooting device comprises:

a feet positioning assembly comprising a shooting foot side bar that extends in a linear direction from a foundation juncture and a non-shooting foot lead bar connected to a slideably adjustable side foot bar, and wherein said non-shooting foot lead bar is pivotally and slideably attached to said shooting foot side bar and wherein said slideably adjustable side foot bar extends in a linear direction parallel to said shooting foot side bar;

a support pole fixedly connected to said foundation juncture of said feet positioning assembly and where said support pole is moveable vertically between an up position and a down position; and said shot box positioned on an upper end of said support pole, wherein said shot box is comprised of a lower shot box bar, an inside shot box obstruction and an outside shot box obstruction, wherein said outside shot box obstruction comprises of an outside shot box bar that extends vertically from said lower shot box bar and an elbow bar that extends perpendicular from a plane created by said lower shot box bar and said outside shot box bar and wherein said inside shot box obstruction comprises of an inside shot box bar that extends vertically from said lower shot box bar, a guide bar that resides parallel to said inside shot box bar and a connecting bar that joins said inside shot box bar to said guide bar; and wherein said non-shooting foot lead bar connected to a slideably adjustable side foot bar is moveable from the ground surface on a left side of said shooting foot side bar to the ground surface on a right side of said shooting foot side bar;

and;

moving said elbow bar located on said shot box to a side of said shot box that corresponds to the shooter's shooting hand and moving said guide bar to the opposite side of said shot box from where said elbow bar resides.

* * * * *